United States Patent [19]

Wilhere

[11] 4,331,186

[45] May 25, 1982

[54] SAFETY PUSH ROD ASSEMBLIES

[75] Inventor: Charles V. Wilhere, Pittsburgh, Pa.

[73] Assignee: Horix Manufacturing Company, McKees Rocks, Pa.

[21] Appl. No.: 213,604

[22] Filed: Dec. 5, 1980

[51] Int. Cl.[3] ..... B65B 3/04

[52] U.S. Cl. ..... 141/98; 24/211 N; 74/527; 141/150; 141/172; 141/275

[58] Field of Search ..... 24/211 N, 201 TR; 74/527; 141/98, 144–152, 168–172, 254, 275–278

[56] References Cited

U.S. PATENT DOCUMENTS 2,907,357 10/1959 Sandhage et al. ..... 141/150 X

*Primary Examiner*—Frederick R. Schmidt

*Attorney, Agent, or Firm*—Brown, Flick & Peckham

[57] ABSTRACT

A safety push rod assembly includes a vertical sleeve adapted to extend through the marginal portion of the bonnet of a rotary container filling machine, in which the sleeve is rigidly mounted. Slidably mounted in the sleeve and extending above it is a tubular upper rod that supports a container rest, and slidably mounted in the upper rod and extending down below the sleeve is a lower rod provided with a transverse passage therethrough inside the upper rod, with a detent ball in each end of the passage and with an axial bore extending from the upper end of the rod down to the transverse passage. In the lower end of the bore and resting on both detent balls is a center ball pressed downwardly by a coil spring compressed between that ball and a stop in the upper end of the bore for urging the detent balls into engagement with the encircling upper rod that is provided with an annular groove receiving projecting portions of the detent balls to thereby normally hold the push rod assembly in extended position. The upper rod is movable downwardly around the lower rod to collapse the assembly if the load on the container rest overcomes the resistance of the detent balls to being forced toward each other against the resistance of the coil spring.

3 Claims, 4 Drawing Figures

1
2
3
9
5
10
4
7
24
22
23
26

SAFETY PUSH ROD ASSEMBLIES

It is known practice to provide a rotary container filling machine with a plurality of push rod assemblies that lift successive containers into position to be filled from filling valves extending downwardly from a tank containing the liquid product. Such a machine is shown in U.S. Pat. No. 2,591,071. It is also known practice to make each push rod assembly from a lower rod on which a tubular upper rod is slidably mounted, with a container rest mounted on the upper end of the upper rod. The two rods, which form a push rod, are normally held in extended position by a spring that presses two detent balls in the lower rod out into an annular groove in the encircling upper rod. Such an arrangement is referred to as a safety push rod because the rod can collapse or telescope if the container being lifted is accidentally misaligned with the overlying filling valve or is otherwise interfered with in its normal upward motion. The filling machine is provided with a cam for pulling down the lower rod in the upper rod to reset a collapsed push rod to its normal extended position at the end of the filling cycle.

The spring and ball detent arrangement has been a desirable way of providing the safety feature for push rods. It is simple and inexpensive. It permits complete collapse of the push rod when a predetermined load has been reached, and the rod remains collapsed even when the load is removed. Another advantage is that it provides a snap action, because push rod collapse occurs only when a predetermined load is reached, without any change in the length of the push rod before that during build-up of the load. This last feature is important because an unwarranted change in length of the push rod during normal operation of the filling machine would affect the opening of the filling valve and the level of liquid in the container being filled.

In spite of all this, improvements have been needed. Thus, since the load at which the safety push rod will collapse is a function of the spring design for a given ball and groove design, efforts to increase the collapsing load by increasing the resistance of the spring have resulted in overstressing the spring, with excessive failures. Furthermore, the force required to reset a collapsed push rod has been approximately half that required to collapse the rod, and reset forces required operating speed limitations to prevent damage to other push rod assembly parts during resetting. Finally, since the required collapsing load is a function of the weight being lifted and the force required to engage and operate the container filling valve, this load varies from machine to machine so that springs of different resistance have been required.

It is among the objects of this invention to overcome the disadvantages just mentioned by providing an improved spring and ball detent system.

The preferred embodiment of the invention is illustrated in the accompanying drawings, in which FIG. 1 is a side view of a container filling machine;

Figure 1:
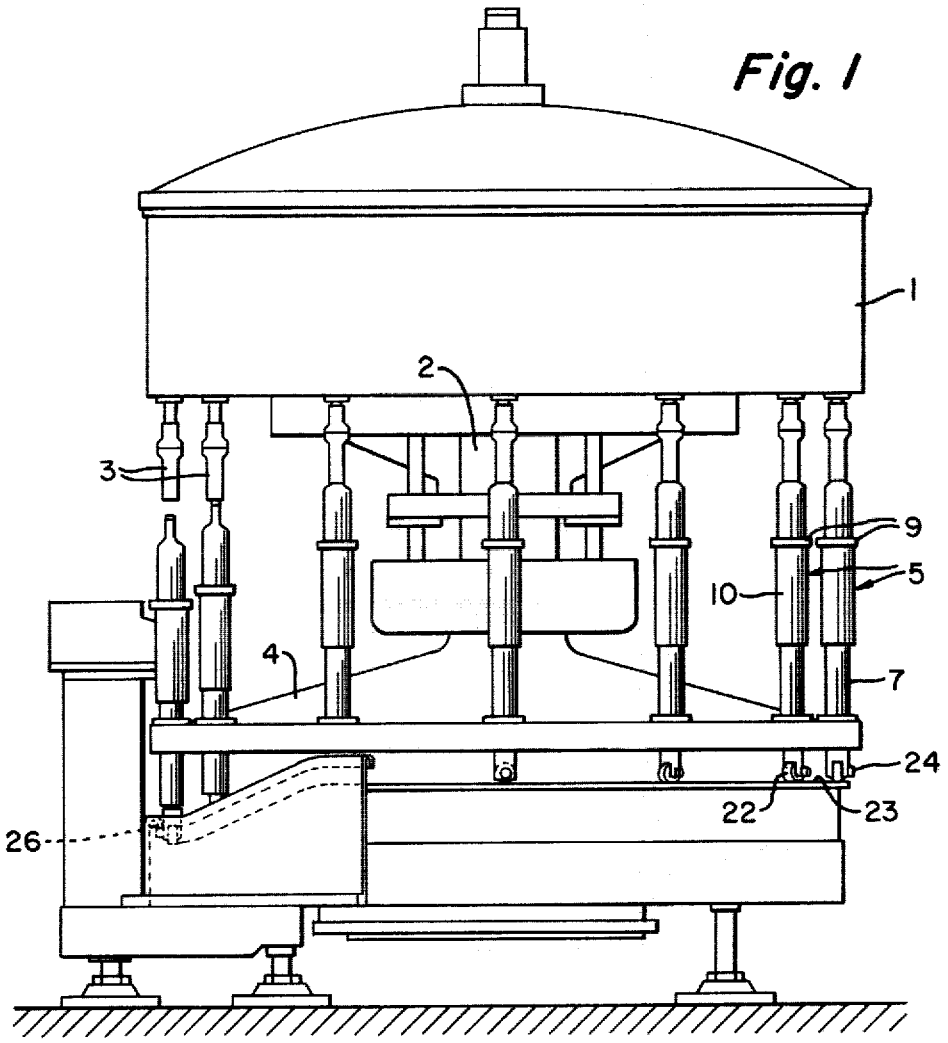
Figure 2:
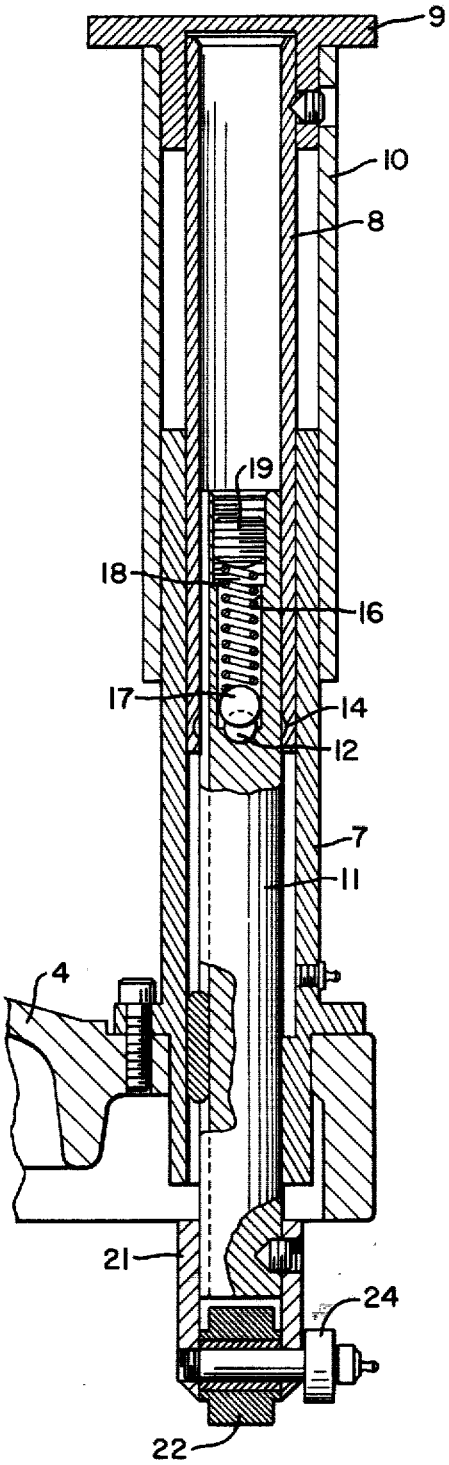
FIG. 2 is an enlarged vertical section through one of the safety push rod assemblies in its extended position.

Referring to FIG. 1 of the drawings, a typical rotary container filling machine includes a tank 1 rigidly mounted on the upper end of a continuously rotatable post 2, with normally closed valves 3 extending downwardly from the tank at circumferentially spaced intervals. Rigidly mounted on the post below the tank and valves is a bonnet 4 that supports circumferentially spaced push rod assemblies 5 beneath the valves. Each assembly, as shown best in FIG. 2, includes a vertical sleeve 7, the lower end portion of which extends through an opening in the bonnet and is rigidly mounted therein. The sleeve extends a considerable distance above the bonnet. Slidably mounted in the sleeve and extending above it is a tubular upper rod 8, on the upper end of which a container rest 9 is rigidly mounted. The upper end of a cover tube 10 is secured to the container rest and extends part way down the sleeve in sliding engagement with it. A lower rod 11 is slidably mounted in the upper rod and extends down below the sleeve. The two rods, which form a push rod, are normally held in extended position by detent balls 12. The balls are disposed in the opposite ends of a transverse passage 13 through the lower rod adjacent the lower end of the upper rod, which is provided with depressions, such as opposite areas of an annular groove 14 into which the balls can project.

Figure 3:
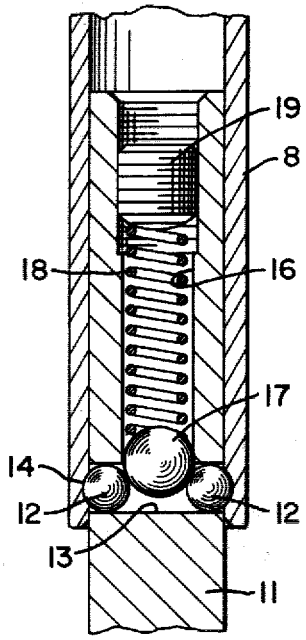
FIG. 3 is a fragmentary vertical section of the assembly shown turned 90° from the position in FIG. 2.

It is a feature of this invention that to project the detent balls into groove 14 the lower rod is provided with an axial bore 16 extending downwardly from its upper end to transverse passage 13 as shown in FIG. 3. In the lower end of this bore there is a center ball 17 that rests on and is supported by both of the detent balls. This center ball is pressed against the detent balls by means of a coil spring 18 in bore 16, the spring being compressed between the center ball and a stop in the upper end of the bore. Preferably, the stop is a plug 19 that is screwed into the upper end portion of the bore so that the plug can be adjusted vertically in order to adjust the tension on the coil spring.

Rotatably mounted in a bracket 21 secured to the lower end of the push rod is the usual cam follower roller 22 that travels on a cam 23 (FIG. 1) which raises and lowers the push rod. A container is placed on container rest 9 when the push rod is down and then is raised to filling position, followed by lowering and removal from the rest. Mounted on the outer end of the same shaft that supports the cam follower roller is the customary pull down roller 24.

OPERATION

Figure 4:
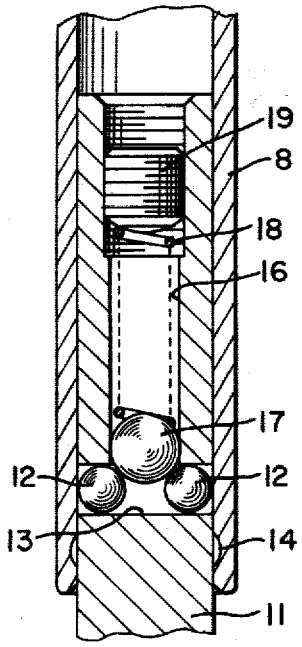
FIG. 4 is a view similar to FIG. 3 but showing the push rod collapsing.

The container filling machine normally operates with all of the push rods extended. However, if the load on a container rest 9 exceeds a predetermined value and creates downward force sufficient to overcome the resistance of the detent balls to being forced toward each other against the resistance of the coil spring, the detent balls will be forced out of groove 14 in the upper rod, thereby permitting the upper rod to slide downwardly on the lower rod as indicated in FIG. 4. As the detent balls are pushed toward each other they must raise the center ball against the resistance of the coil spring. That resistance can be adjusted by screwing plug 19 up or down in the upper end of the lower rod. After the collapsed push rod has left the container-filling station, the pull down roller 24 engages a cam 26 (FIG. 1) that pulls the lower rod down in the upper rod until the coil spring again forces the detent balls out into the groove in the upper rod. The push rod then is back to normal.

An advantage of this new detent arrangement is that by placing the coil spring in the axial bore as shown, a very conservative spring design is possible with larger wire diameter, larger coil diameter and more coils. This permits the collapsing load to be increased above what was formerly possible. For example, the former maximum obtainable collapsing load was about 150 lbs. but with the new detent system a collapsing load of about 250 lbs. is readily attainable. The load at which the push rod collapses is now a function of not only the spring and groove 14, but also the wedge angle of the center ball with the detent balls. When the push rod collapses, the center ball is lifted between the detent balls so that the wedge angle is reduced. Even though the spring is compressed further by the rise of the center ball, the net effect of the change in spring load and wedge angle is that the upper rod moves in contact with the detent balls with less resistance than.in the push rod assembly known heretofore. Consequently, reset force requirements have been reduced from about 50% of collapsing load to as little as 5% collapsing load and higher operating speeds are attainable. The new detent system permits adjustment of the collapsing load even with the two rods assembled. The screw plug 19 can be adjusted to a precalibrated position to obtain any desired collapsing load.

With the detent arrangement disclosed herein it is possible to use four or more detent balls so as to reduce groove wear. To use four balls, a second passage at right angles to passage 13 is drilled through the lower rod and a detent ball is disposed in each end of the second passage. In such a case the center ball 17 at the intersection of the two passages engages all four detent balls.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Safety push rod assemblies for a container filling machine provided with a circular bonnet rotatable continuously on a vertical axis beneath a filling tank, each of said assemblies comprising a vertical sleeve adapted to extend through the marginal portion of the bonnet and be rigidly mounted therein, a tubular upper rod slidably mounted in said sleeve and extending above it, a container rest mounted on top of the sleeve, a lower rod slidably mounted in said upper rod and extending down below said sleeve, a lower rod being provided with a transverse passage therethrough inside the upper rod, a detent ball in each end of said passage, the lower rod also having an axial bore extending from its upper end down to said passage, a center ball in the lower end of said bore resting on both detent balls, a stop in the upper end of said bore, a coil spring compressed between said stop and center ball for urging said detent balls into engagement with the encircling upper rod, the upper rod having depressions in its inner surface receiving the portions of the detent balls projecting from said passage to thereby normally hold the push rod assembly in extended positions with said container rest spaced a predetermined distance from the lower end of the lower rod, a cam follower roller carried by the lower end of the lower rod for raising both rods to elevate a container on said rest into filling position, the upper rod being movable downwardly around the lower rod to collapse said assembly if the load on said rest creates a downward force that overcomes the resistance of the detent balls to being forced toward each other against the resistance of said coil spring, and a pull down roller carried by the lower end of the lower rod for pulling that rod downwardly in the upper rod until said coil spring forces the detent balls out into said depressions again.

2. Safety push rod assemblies according to claim 1, in which said stop is a vertically adjustable plug screwed into said bore for adjusting the coil spring tension.

3. Safety push rod assemblies according to claim 1, including a cover tube slidably mounted on said sleeve with the upper end of the tube secured to said container rest.

* * * * *